US011248385B2

(12) United States Patent
Willwater

(10) Patent No.: US 11,248,385 B2
(45) **Date of Patent: *Feb. 15, 2022**

(54) LID AND STRAINER BASKET ASSEMBLY AND POOL SKIMMER INCORPORATING SAME

(71) Applicant: Sandra H. Willwater, Gilbert, AZ (US)

(72) Inventor: Sandra H. Willwater, Gilbert, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/105,805

(22) Filed: Nov. 27, 2020

(65) Prior Publication Data

US 2021/0095489 A1 Apr. 1, 2021

Related U.S. Application Data

(63) Continuation of application No. 16/932,094, filed on Jul. 17, 2020, now Pat. No. 10,851,555, which is a continuation of application No. 16/854,674, filed on Apr. 21, 2020, now Pat. No. 10,731,367.

(60) Provisional application No. 62/837,619, filed on Apr. 23, 2019.

(51) Int. Cl.
*E04H 4/12* (2006.01)
*B66F 19/00* (2006.01)

(52) U.S. Cl.
CPC ..... *E04H 4/1272* (2013.01); *B66F 19/00* (2013.01)

(58) Field of Classification Search
CPC ..... E04H 4/127; B66F 19/00
USPC ..... 210/167.1, 237, 238, 448, 416.1, 416.2
See application file for complete search history.

(56) References Cited

U.S. PATENT DOCUMENTS

| | | | |
|---|---|---|---|
| 1,969,494 | A | 8/1934 | Balzer |
| 2,038,993 | A | 4/1936 | Erlanger |
| 2,039,024 | A | 4/1936 | Otis |
| 4,515,023 | A | 5/1985 | Kershner |
| 5,564,583 | A | 10/1996 | Kelley et al. |
| 6,422,623 | B1 | 7/2002 | Thomas |
| 6,706,174 | B1 | 3/2004 | Keith |
| 7,309,088 | B2 | 12/2007 | Fiore et al. |
| 7,644,535 | B2 | 1/2010 | Sloop |
| 8,430,438 | B2 | 4/2013 | Murphy |
| 9,387,583 | B1 | 7/2016 | Coan |
| 2002/0020104 | A1 | 2/2002 | Kolar et al. |

(Continued)

*Primary Examiner* — Fred Prince
(74) *Attorney, Agent, or Firm* — Parsons & Goltry, PLLC; Michael W. Goltry; Robert A. Parsons

(57) ABSTRACT

A lid and strainer basket assembly for use in a recirculating system of a swimming pool installation including a swimming pool and a deck, the recirculating system having a skimmer device extending downwardly from an opening proximate to the deck and coupled to a pump for recirculating the water in the swimming pool, the lid and strainer basket assembly including a removable lid closing the opening, a strainer basket in the skimmer device for collecting debris from the water, and an assembly of straps coupling the removable lid to the strainer basket, the straps being both sufficiently flexible and slacked between the lid and the strainer basket to enable the lid to be removed from the opening and tipped to one side to enable visual inspection of the strainer basket in the skimmer device without interference from the straps and without disturbing the strainer basket.

15 Claims, 11 Drawing Sheets

(56) References Cited

U.S. PATENT DOCUMENTS

| | | | | |
|---|---|---|---|---|
| 2005/0183331 | A1* | 8/2005 | Kania | A01K 61/70 47/65.5 |
| 2007/0124995 | A1* | 6/2007 | Kania | A01K 61/70 47/59 R |
| 2009/0120857 | A1 | 5/2009 | Bair | |
| 2014/0015267 | A1 | 1/2014 | Smith | |
| 2015/0068961 | A1 | 3/2015 | Zars et al. | |
| 2015/0267430 | A1* | 9/2015 | Kemp | E04H 4/1272 210/167.19 |
| 2016/0326762 | A1 | 11/2016 | Goettl | |

* cited by examiner

LID AND STRAINER BASKET ASSEMBLY AND POOL SKIMMER INCORPORATING SAME

CROSS-REFERENCE TO RELATED APPLICATION

This application claims the benefit of U.S. Provisional Patent Application No. 62/837,619, filed 23 Apr. 2019, which is incorporated herein by reference.

FIELD OF THE INVENTION

This invention relates to swimming pools.

More particularly, the present invention relates to skimmer devices of swimming pools.

In a further and more specific aspect, the instant invention concerns a lid and strainer basket assembly for a skimmer device of a swimming pool.

BACKGROUND OF THE INVENTION

A conventional swimming pool installation usually incorporates a recirculating system having a pump and a filter assembly located adjacent the pool for circulating and filtering the pool water. Typically included in this recirculating system is a skimming device adjacent the sidewall of the pool and a main drain located on the floor of the pool. Water from the pool is drawn through the skimming device and the main drain by the pump, and forced through the filter assembly before being returning to the pool through a discharge outlet. The skimmer device is configured to removes the film of material and floating objects from the surface of the water while the main drain is adapted to collect sediment which sinks to the bottom of the pool. A small filter basket is usually provided in the system before the pump to intercept debris picked up by the main drain or which has passed through the skimmer device.

In a properly maintained pool, the skimmer device will keep the surface of the pool clean, and remove large debris before it sinks. The skimmer device extends downwardly from an opening proximate to the deck, a removable strainer basket that captures the film of material and floating objects from the surface of the water, and a removable lid for closing the opening at the top of the skimmer device. The strainer basket can be emptied of the collected debris. This is accomplished by opening the lid, removing the strainer basket from the skimmer device through the opening, evacuating debris collected in the strainer basket, returning the strainer basket to the skimmer device through the opening, and closing the lid. Since the lid is located at the pool deck, removing the lid requires the user bend down to remove the lid, and then bend down even further to reach the strainer basket. For many pool owners this task is difficult, especially for the physically impaired.

SUMMARY OF THE INVENTION

A lid and strainer basket assembly is disclosed for use in a recirculating system of a swimming pool installation including a swimming pool and a deck, the recirculating system having a skimmer device extending downwardly from an opening proximate to the deck and coupled to a pump for recirculating the water in the swimming pool. The lid and strainer basket assembly includes a removable lid closing the opening, a strainer basket in the skimmer device for collecting debris from the water, and an assembly of straps coupling the removable lid to the strainer basket, the straps being both sufficiently flexible and slacked between the lid and the strainer basket to enable the lid to be removed from the opening and tipped to one side to enable visual inspection of the strainer basket in the skimmer device without interference from the straps and without disturbing the strainer basket. The assembly of straps includes a first strap coupled to the lid, and a second strap coupled between the first strap and the strainer basket. The first strap is releasably coupled to the lid, and is looped through openings in the lid in an illustrative embodiment. The second strap is preferably releasably coupled to the first strap and to the strainer basket. In an illustrative embodiment, the assembly of straps additionally includes a third strap releasably coupled to the strainer basket, and the second strap is coupled to the third strap. The third strap encircles and is releasably secured about the strainer basket in a preferred embodiment.

According to the principle of the invention, improvements to a recirculating system of a swimming pool installation are disclosed. The swimming pool installation includes a swimming pool and a deck, the recirculating system having a skimmer device extending downwardly from an opening proximate to the deck and coupled to a pump for recirculating the water in the swimming pool, a removable lid closing the opening, and a strainer basket in the skimmer device for collecting debris from the water. The improvements include an assembly of straps connecting the removable lid to the strainer basket, the straps being both sufficiently flexible and slacked between the lid and the strainer basket to enable the lid to be removed from the opening and tipped to one side to enable visual inspection of the strainer basket in the skimmer device without interference from the straps and without disturbing the strainer basket. The assembly of straps includes a first strap coupled to the lid, and a second strap coupled between the first strap and the strainer basket. The first strap is releasably coupled to the lid, and is looped through openings in the lid in an illustrative embodiment. The second strap is preferably releasably coupled to the first strap and to the strainer basket. In an illustrative embodiment, the assembly of straps additionally includes a third strap releasably coupled to the strainer basket, and the second strap is coupled to the third strap. The third strap encircles and is releasably secured about the strainer basket in a preferred embodiment.

In a recirculating system of a swimming pool installation including a swimming pool and a deck, the recirculating system having a skimmer device extending downwardly from an opening proximate to the deck and coupled to a pump for recirculating the water in the swimming pool, a method according to the principle of the invention includes providing a lid and a strainer basket for the skimmer device, coupling the lid to the strainer basket with an assembly of straps, lowering the strainer basket into the skimmer device through the opening, and closing the opening with the lid, the straps depending downwardly into the skimmer device between the lid and the strainer basket and being both sufficiently flexible and slacked between the lid and the strainer basket to enable the lid to be removed from the opening and tipped to one side to enable visual inspection of the strainer basket in the skimmer device without interference from the straps and without disturbing the strainer basket. The assembly of straps includes a first strap and a second strap, and the step of coupling the lid to the strainer basket with the assembly of straps includes coupling the first strap to the lid, and coupling a second strap between the first strap and the strainer basket. The step of coupling the first strap to the lid includes releasably coupling the first strap to the lid. The step of coupling the first strap to the lid additionally includes looping the first strap through openings in the lid. The step of coupling the second strap between the first strap and the strainer basket includes releasably coupling the second strap to the first strap and to the strainer basket. The assembly of straps additionally includes a third strap, and the step of releasably coupling the second strap to the strainer basket includes releasably coupling the third strap to the strainer basket, and coupling the second strap to the third strap. The step of releasably coupling the third strap to the strainer basket includes banding the third strap around the strainer basket.

BRIEF DESCRIPTION OF THE DRAWINGS

Specific objects and advantages of the invention will become readily apparent to those skilled in the art from the following detailed description of illustrative embodiments thereof, taken in conjunction with the drawings in which.

DETAILED DESCRIPTION

Figure 1:
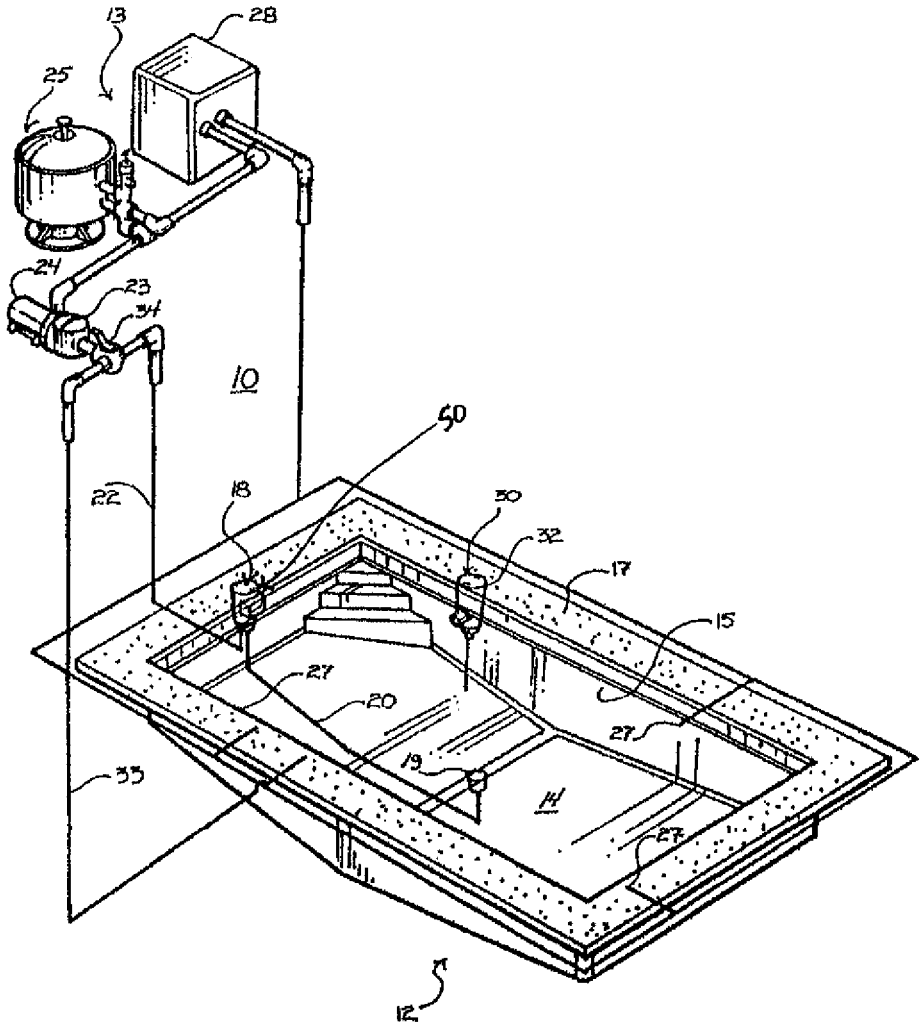
FIG. 1 is a perspective view of a swimming pool installation including a skimmer device incorporating a lid and strainer basket assembly constructed and arranged in accordance with the principle of the invention.

Turning to the drawings, FIG. 1 illustrates a swimming pool installation 10 including a swimming pool 12 and a recirculating system 13. Swimming pool 12 is substantially any type known to those skilled in the art, and includes a floor 14, sidewall 15 and a deck 17. Recirculating system 13 includes a skimmer device 18 mounted adjacent to sidewall 15 and into deck 17, a main drain 19 mounted in floor 14 and coupled to skimmer device 18 by a conduit 20, and a vacuum system 30. A conduit 22 connects skimmer device 18 to a valve system 23, which is in turn coupled to a pump 24, which is configured to cycle between inactive and active conditions. In the active condition, pump 24 draws pool water through main drain 19 and the skimmer device 18 and valve system 23, forcing the water through a filter assembly 25 and back into swimming pool 12 through discharge outlets 27. Skimmer device 18 is furnished with a strainer basket and a removable lid of a lid and strainer basket assembly 50 for allowing the strainer basket to be removed and cleaned. As will be apparent to one skilled in the art, additional elements may be added to recirculating system 13, such as a water heater 28 coupled between filter assembly 25 and discharge outlets 27.

Vacuum system 30 includes a vacuum module 32 mounted adjacent to sidewall 15 and into deck 17. A conduit 33 connects vacuum module 32 to valve system 23. A vacuum device 34 is coupled to vacuum module 32 by a vacuum hose. As pump 24 draws water through vacuum system 30, suction is created within vacuum module 32, which is communicated along the vacuum hose to vacuum device 34. This suction picks up debris with the pool water and provides motive force for vacuum device 34. Water and debris pulled through the vacuum hose enters vacuum module 32 through an inlet and exits through an outlet after passing through a strainer basket disposed therein, which collects the larger debris while the smaller particles pass through conduit 33 to filter assembly 25. Vacuum module 32 is furnished with a removable lid for allowing the strainer basket to be removed and cleaned.

Figure 2:
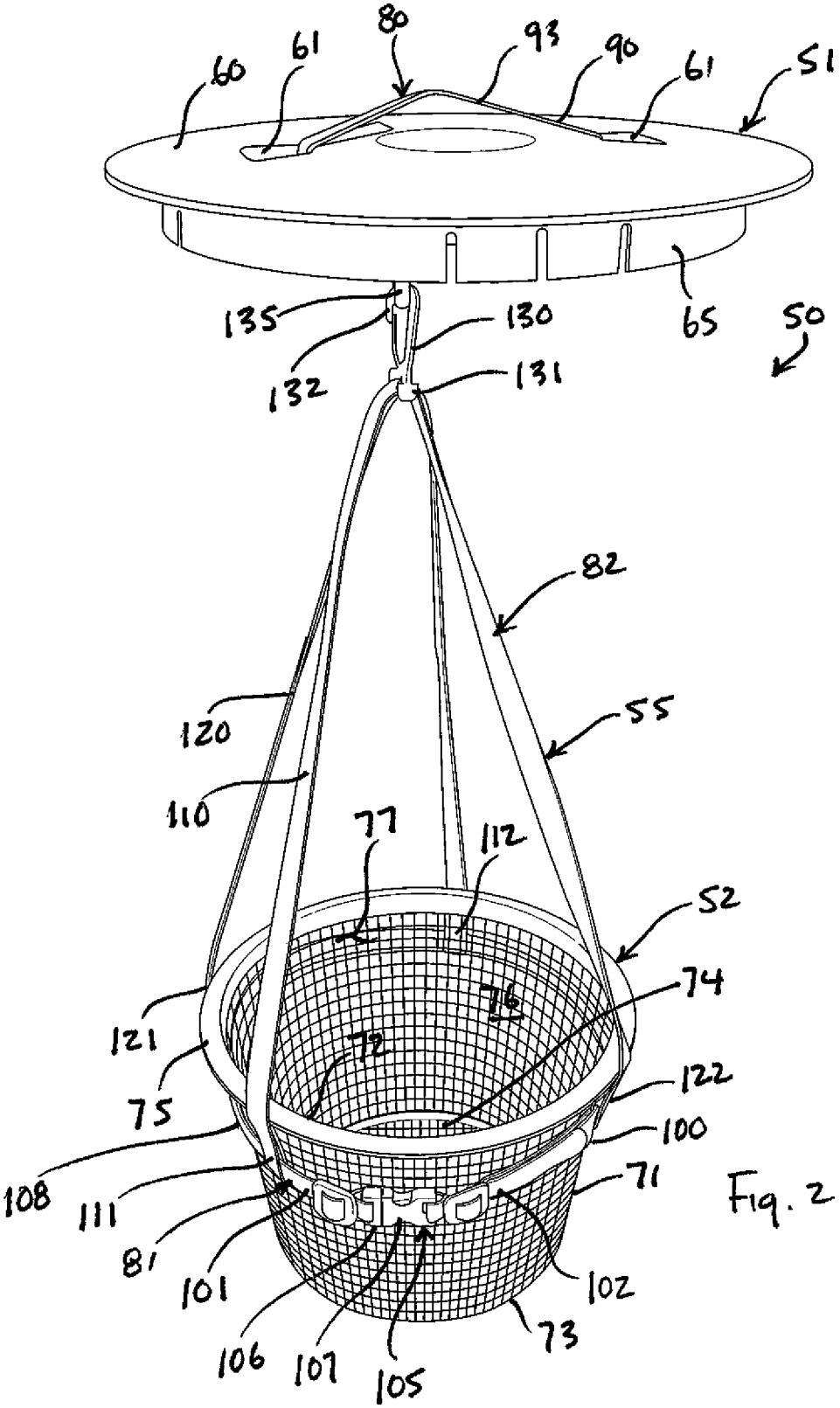
FIG. 2 is a perspective views of the lid and strainer basket assembly of FIG. 1, the lid and strainer basket assembly including a lid, a strainer basket, and a strap assembly connecting the lid to the strainer basket.
Figure 3:
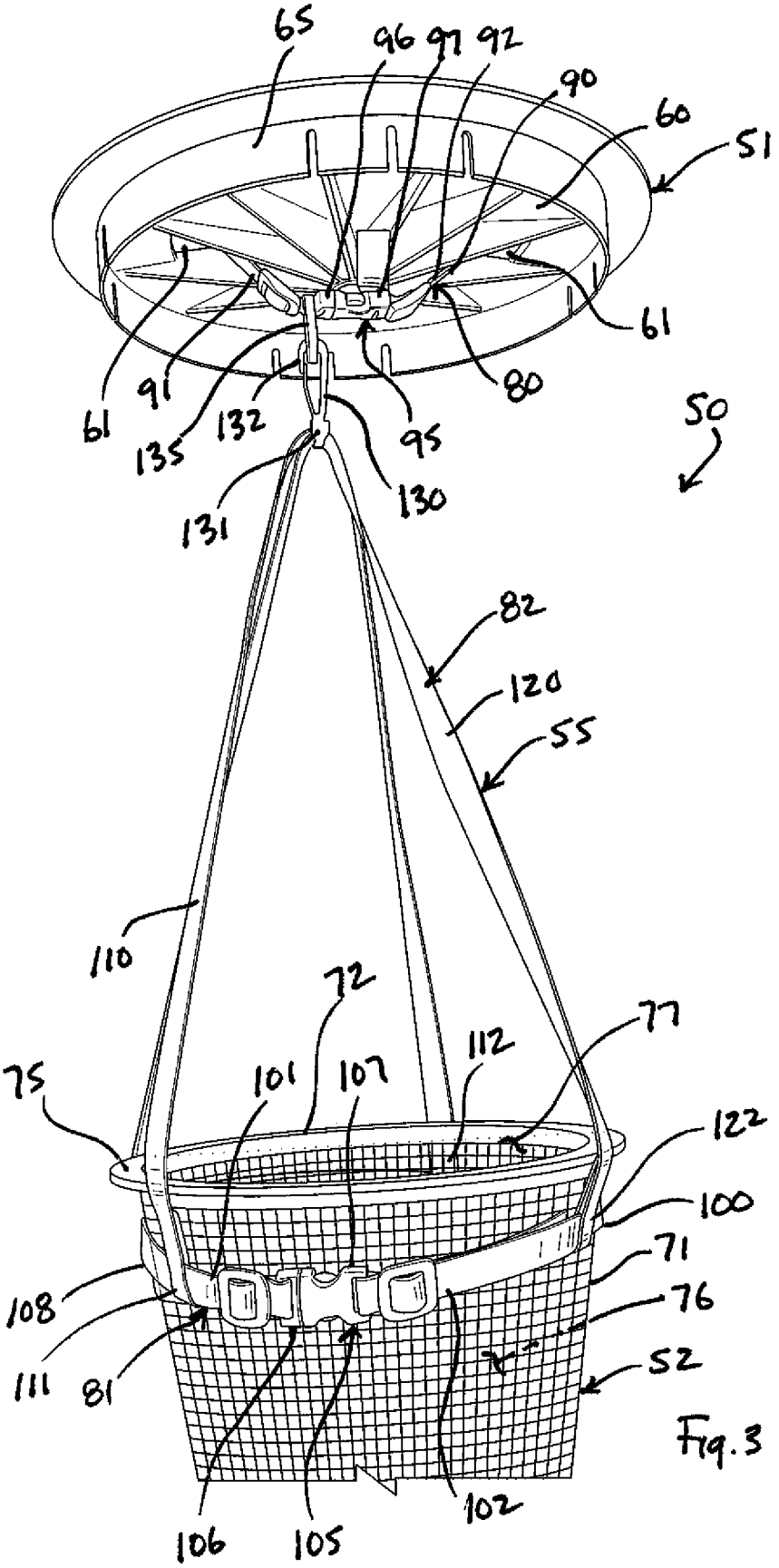
FIG. 3 is a perspective view of the embodiment of FIG. 2 illustrating the underside of the lid, the strainer basket being partially illustrated.

Referring to FIGS. 2 and 3, lid and strainer basket 50 constructed and arranged in accordance with the principle of the invention includes lid 51, strainer basket 52, and strap assembly 55 connecting lid 51 to basket 52. Lid 51 and basket 52 are standard and well known. Briefly, lid 51 includes disc-shaped cover section 60 formed with the standard finger holes 61 and collar 65 depending downwardly from the underside of cover section 60 for reception in the standard collar formed in the standard opening through pool deck 17 in FIG. 1 to the interior of skimmer 18. Basket 52 includes continuous sidewall 71 having upper edge 72, and lower edge 73. Horizontal bottom 74 is affixed to lower edge 73. Continuous lip or flange 75 is affixed to upper edge 72. Flange 75 radiates outwardly from upper edge 72. Bottom 74 cooperates continuous sidewall 71 to form volume 76. Upper edge 72 encircles opening 77 to volume 76. Sidewall 71 and bottom 74 are foraminate, being formed with numerous openings therethrough for enabling water to pass freely therethrough, while at the same time disabling debris, such as leaves, bugs, flower pedals, and other floating debris from passing therethrough. Accordingly, basket 52 is fluid pervious and is a standard foraminate basket 52. Volume 76 is for collecting contents, floating debris from pool water driven through basket 52 from opening 77. Continuous sidewall 71 is cylindrically tapered from upper edge 72 to lower edge 73, in which basket 52 is conical in shape, being shaped as an inverted truncated cone that tapers in diameter over its height from upper edge 72 to horizontal bottom 74.

Strap assembly 55 in FIGS. 2 and 3 includes lid part 80, basket part 81, and connecting part 82. Connecting part 82 is coupled between lid part 80 and basket part 81. Lid part 80 is coupled to lid 51. Basket part 81 is coupled to basket 52. Connecting part 82 connects lid part 80 to basket part 81 thereby coupling basket 52 to lid 51.

Lid part 80 is coupled to lid 51 without modifying lid 51 in any way. Lid part 80 is preferably releasably coupled to lid 51 without modifying lid 51 in any way, enabling lid part 80 to be attached to lid 51 and detached from lid 51 as desired without modifying lid 51. Basket part 81 is coupled to basket 52 without modifying basket 52 in any way. Basket part 81 is preferably releasably coupled to basket 52 without modifying basket 52 in any way, enabling basket part 81 to be attached to basket 52 and detached from basket 52 as desired without modifying basket 51.

Figure 4:
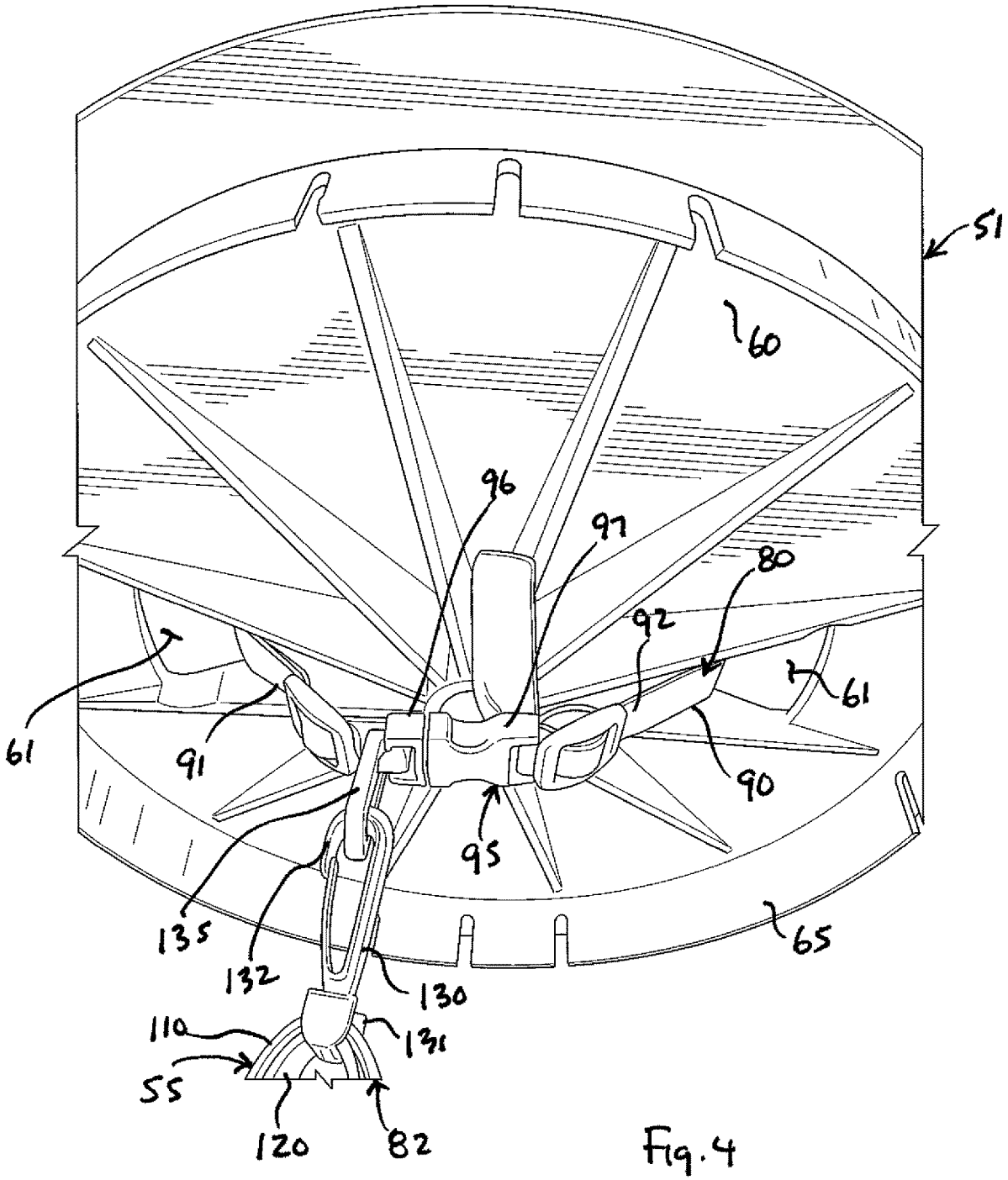
FIG. 4 is an enlarged fragmentary view corresponding to FIG. 3 illustrating the underside of the lid.

Referring in relevant part to FIG. 2, FIG. 3, and FIG. 4, lid part 80 includes strap 90 fitted with a suitable standard buckle assembly 95 including standard male part 96 connected to one end 91 of strap 90 and a standard female part 97 connected to the other end 92 of strap 90. Strap 90 is neither rigid nor inflexible, and is fashioned beneficially of nylon, canvass, other material or combination of materials having inherently flexible, pliant, tear-resistant, rugged and resilient material characteristics. In this example, buckle assembly 95 is fashioned of plastic, carbon fiber, or other material or combination of materials having inherently resilient, flexible, and rugged material characteristics. Male and female parts 96 and 97 of buckle assembly 95 connected to respective ends 91 and 92 of strap 90 are passed through the respective finger holes 61 from the outer side of cover section 60 and are buckled together on the underside of cover section by inserting male part 96 into female part 97 thereby securing strap 90 encircling a central section of cover section 60 between finger holes 61. This forms a length of strap 90 as a handle 93 on the outer side of cover section 60 that extends from one finger hole 61 to the other finger hole 61. Handle 93 formed by strap 90 can be taken up, such as by hand or an implement held by hand, for taking up lid 51. Strap 90 can be length-adjustable for enabling a user to tighten strap 90 as needed. To detach lid part 80 from lid 51, the foregoing operation need only be reversed.

Referring in relevant part to FIGS. 2 and 3, basket part 81 includes strap 100 fitted with a suitable standard buckle assembly 105 including a standard male part 106 connected to one end 101 of strap 100 and a standard female part 107 connected to the other end 102 of strap 100. Strap 100 is neither rigid nor inflexible and is fashioned beneficially of nylon, canvass, other material or combination of materials having inherently flexible, pliant, tear-resistant, rugged and resilient material characteristics. In this example, buckle assembly 105 is fashioned of plastic, carbon fiber, or other material or combination of materials having inherently resilient, flexible, and rugged material characteristics. Strap 100 is wrapped exteriorly around continuous sidewall 71 to encircle continuous sidewall near upper edge 72 under flange 75 between flange 75 and lower edge 73 and male and female parts 106 and 107 of buckle assembly 105 are buckled together on the outer side of continuous sidewall 71 by inserting male part 106 into female part 107 thereby securing strap 100 exteriorly encircling/girdling continuous sidewall 71. The secured strap 100 exteriorly encircling/girdling continuous sidewall 71 is a girdle denoted at 108, which encircles and frictionally retains basket 52. Strap 100 can be length-adjustable for enabling a user to tighten strap 100 as needed. To detach basket part 81 from basket 52, the foregoing operation need only be reversed, or basket 52 can simply be lifted upwardly and away from the formed girdle 108 without detaching male part 106 from female part 107. The girdle 108 can be formed in advance, and basket 52 simply lowered through girdle 108 bottom 74 first.

With continuing reference to FIGS. 2 and 3, connecting part 82 includes straps 110 and 120 and coupling 130. Straps 110 and 120 are neither rigid nor inflexible, and are each fashioned beneficially of nylon, canvass, other material or combination of materials having inherently flexible, pliant, tear-resistant, rugged, and resilient material characteristics. Strap 110 is elongate and has opposed ends 111 and 112. Strap is 120 is equal in length to strap 110 and includes opposed ends 121 and 122. In FIG. 4, coupling 130 is a standard and well-known snap coupling or carabiner of plastic or metal including collared end 131 and an opposed openable/closable end 132 connected to a circular link 135 looped around strap 90 at the underside of lid 51 in this example adjacent to male part 96 of buckle assembly 95. Straps 110 and 120 are approximately 2-4 feet in length in this example. In FIGS. 2 and 3, ends 111 and 112 of strap 110 are coupled to strap 100 at opposed sides of girdle 108, and a central part of strap 110 extends through collared end 131. Ends 121 and 122 of strap 120 are also coupled to strap 100 at opposed sides of girdle 108, and a central part of strap 120 extends through collared end 131 concurrently with strap 110. Ends 111, 112, 121 and 122 of the respective straps 110 and 120 are circumferentially offset by approximately 90 degrees in this example. This enables straps 110 and 120 when suspended from coupling 130 at their central parts to suspend basket 52 held by girdle 108 stably upright from bottom 74 to upper edge 72 in FIGS. 2 and 3 when lid 51 is held at an elevated location, such as by holding handle 93 or lid 51 by hand or with the use of a hand-held implement. The lengths of straps 110 and 120 are chosen to suspend basket approximately 1-2 feet under lid 51. In this illustrative embodiment, ends 111, 112, 121 and 122 of the respective straps 110 and 120 are looped ends through which strap 100 extends. This enables a user to slide the looped ends of strap 110 and 120 along strap 100 of girdle 108 to their illustrative circumferentially offset positions. Ends 111, 112, 121 and 122 of the respective straps 110 and 120 can be coupled to strap 100 of girdle 108 in other ways, such as adhesively, by heat bonding, clips, snap fasteners, buckles, etc.

Figure 5:
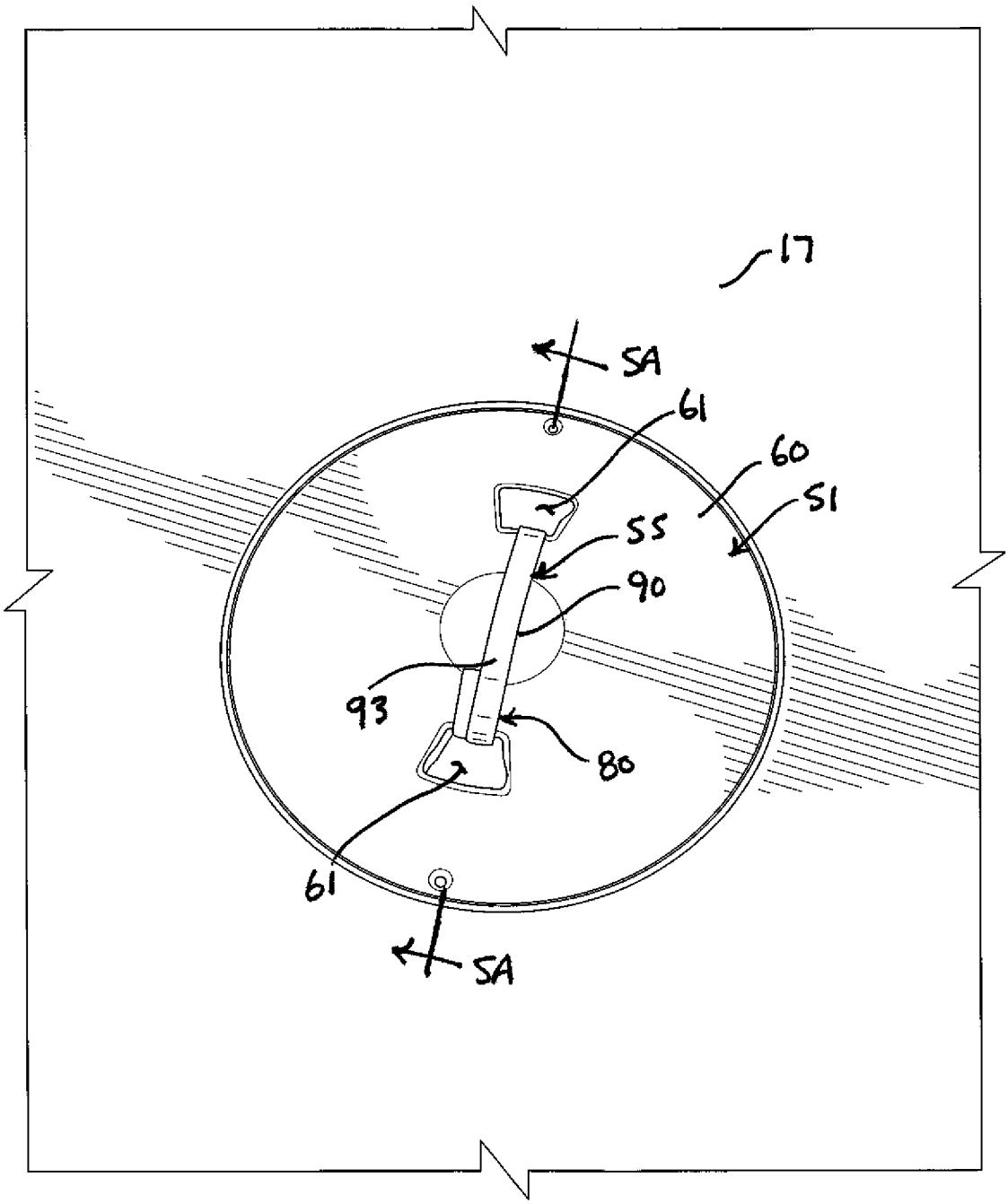
FIG. 5 is a generalized perspective view corresponding to FIG. 1 illustrating the lid and strainer basket assembly appear installed in the skimmer device of the swimming pool installation.
Figure 5A:
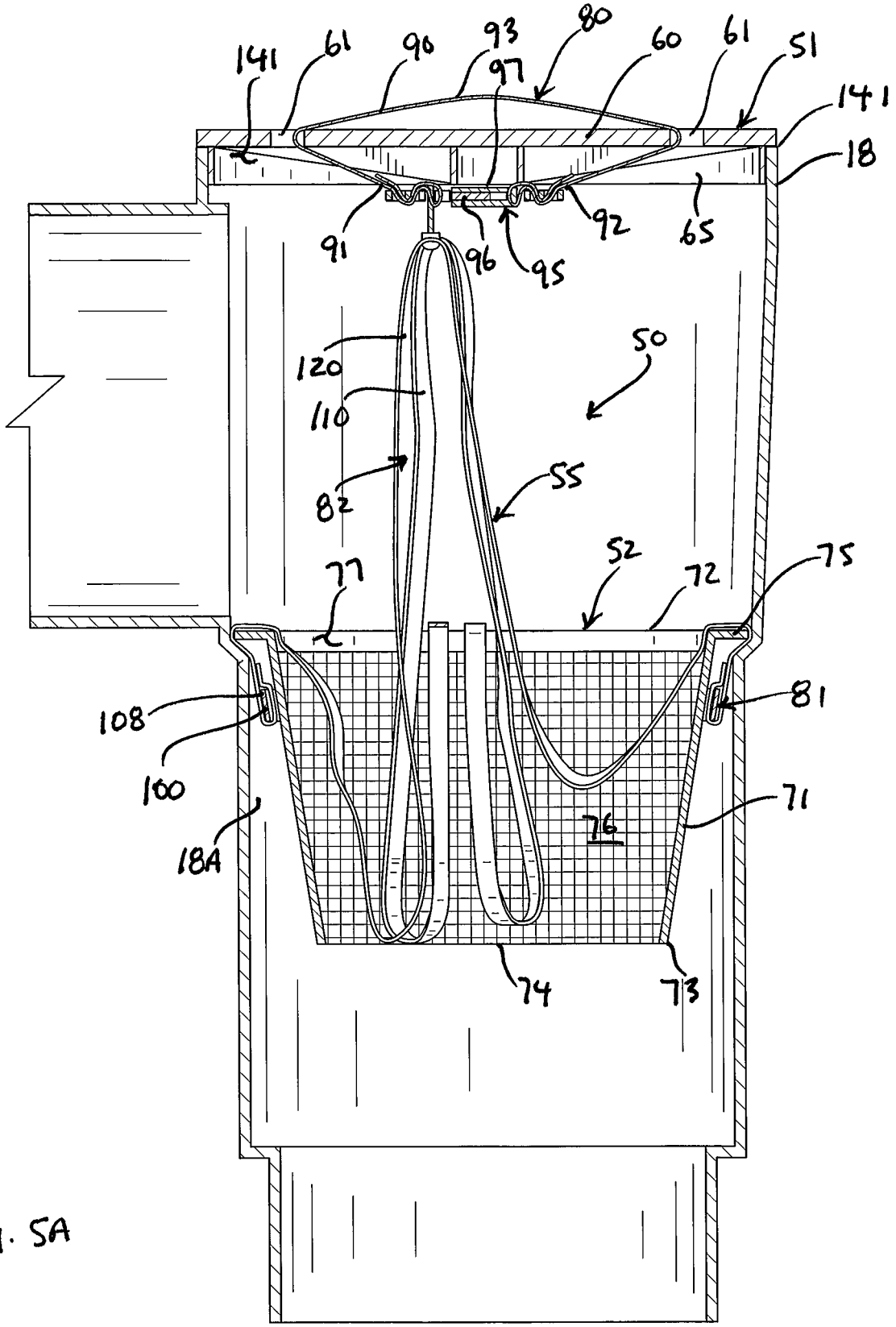
FIG. 5A is a section view taken along line 5A-5A of FIG. 5, illustrating the lid and strainer basket assembly installed in the skimmer device.
Figure 6:
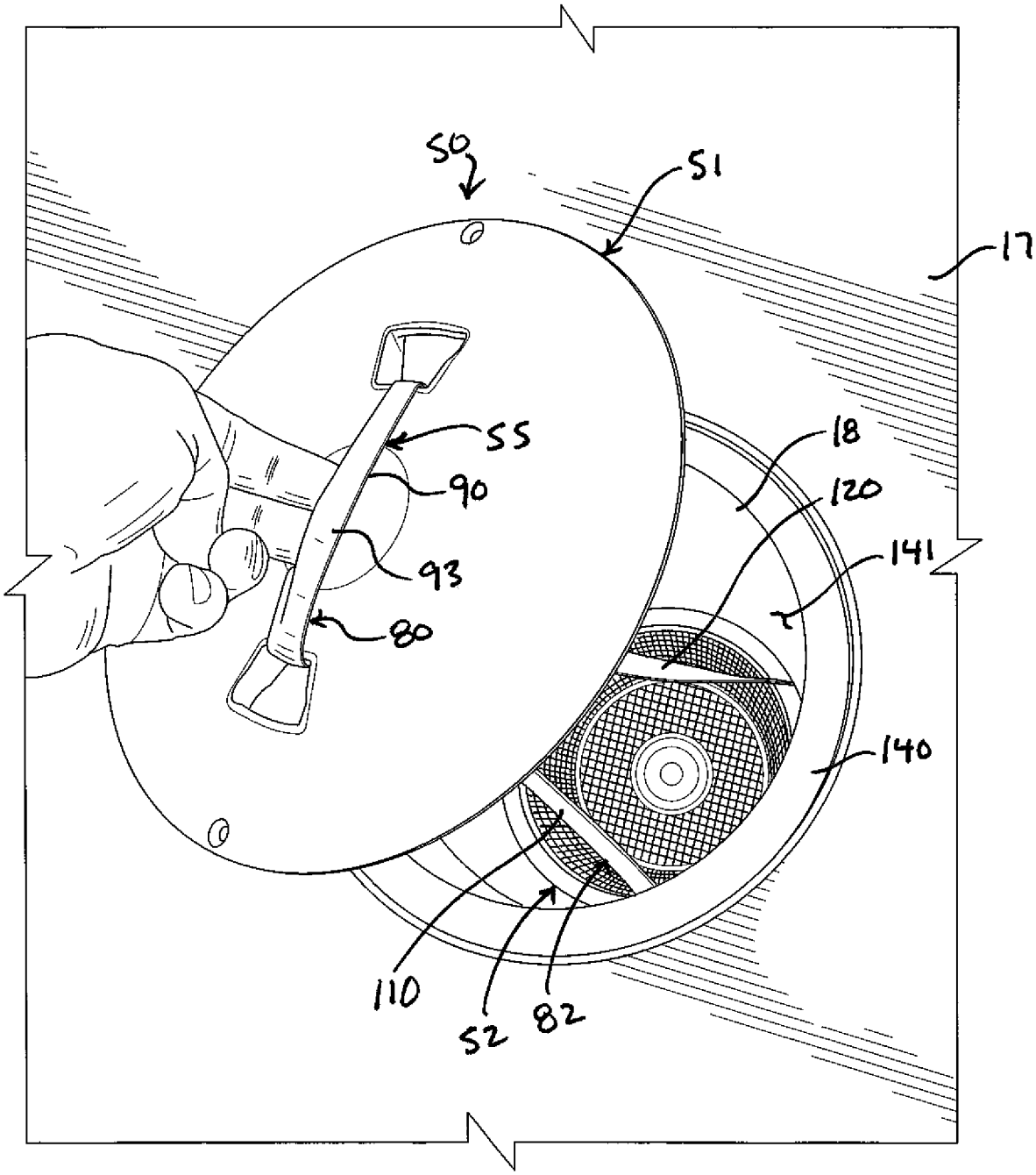
FIGS. 6 and 7 are views corresponding to FIGS. 5 and 5A illustrating the lid withdrawn from an opening through a pool deck of the swimming pool installation to inside the skimmer device and to the basket of FIGS. 2 and 3 placed therein.
Figure 7:
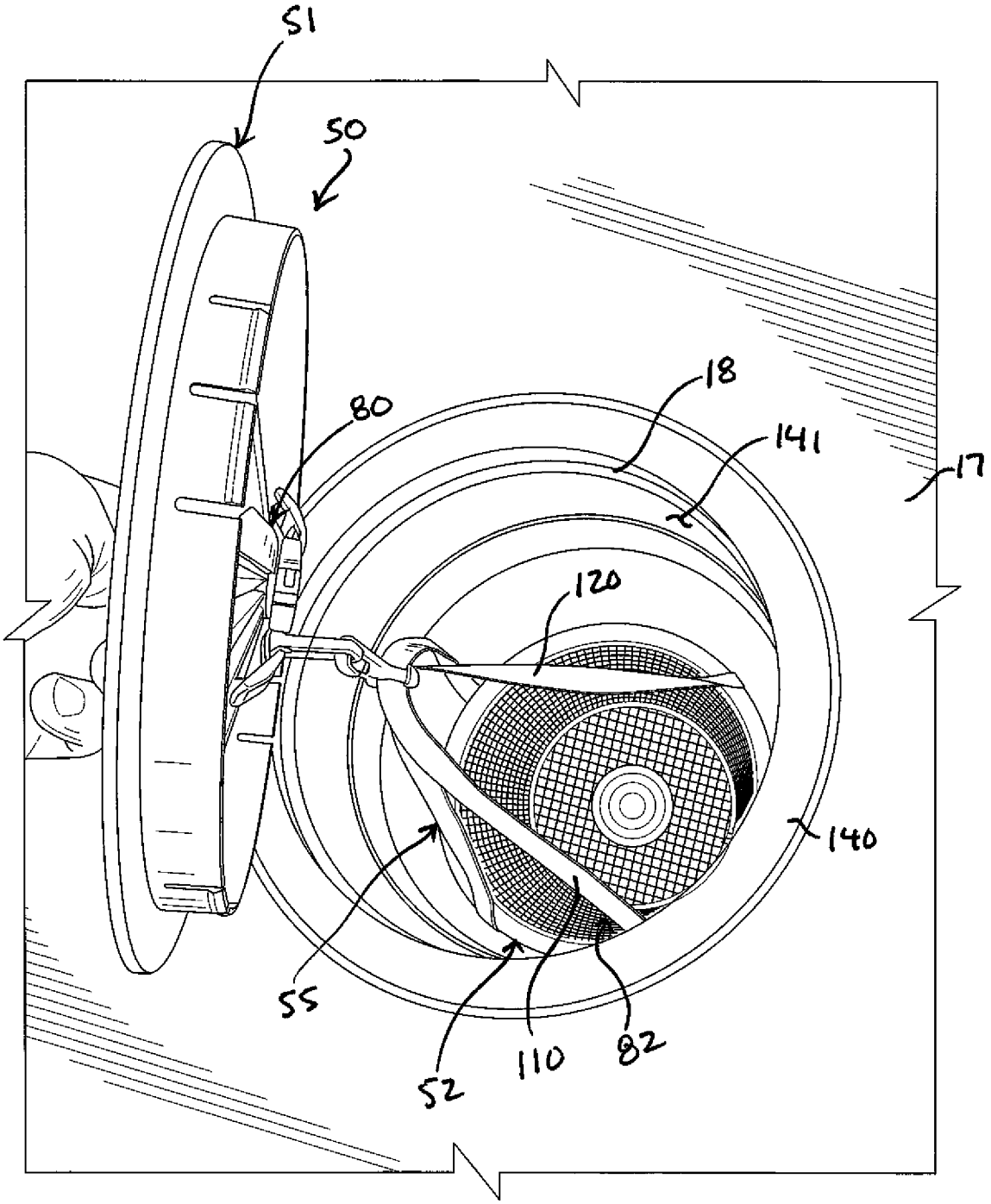
Figure 8:
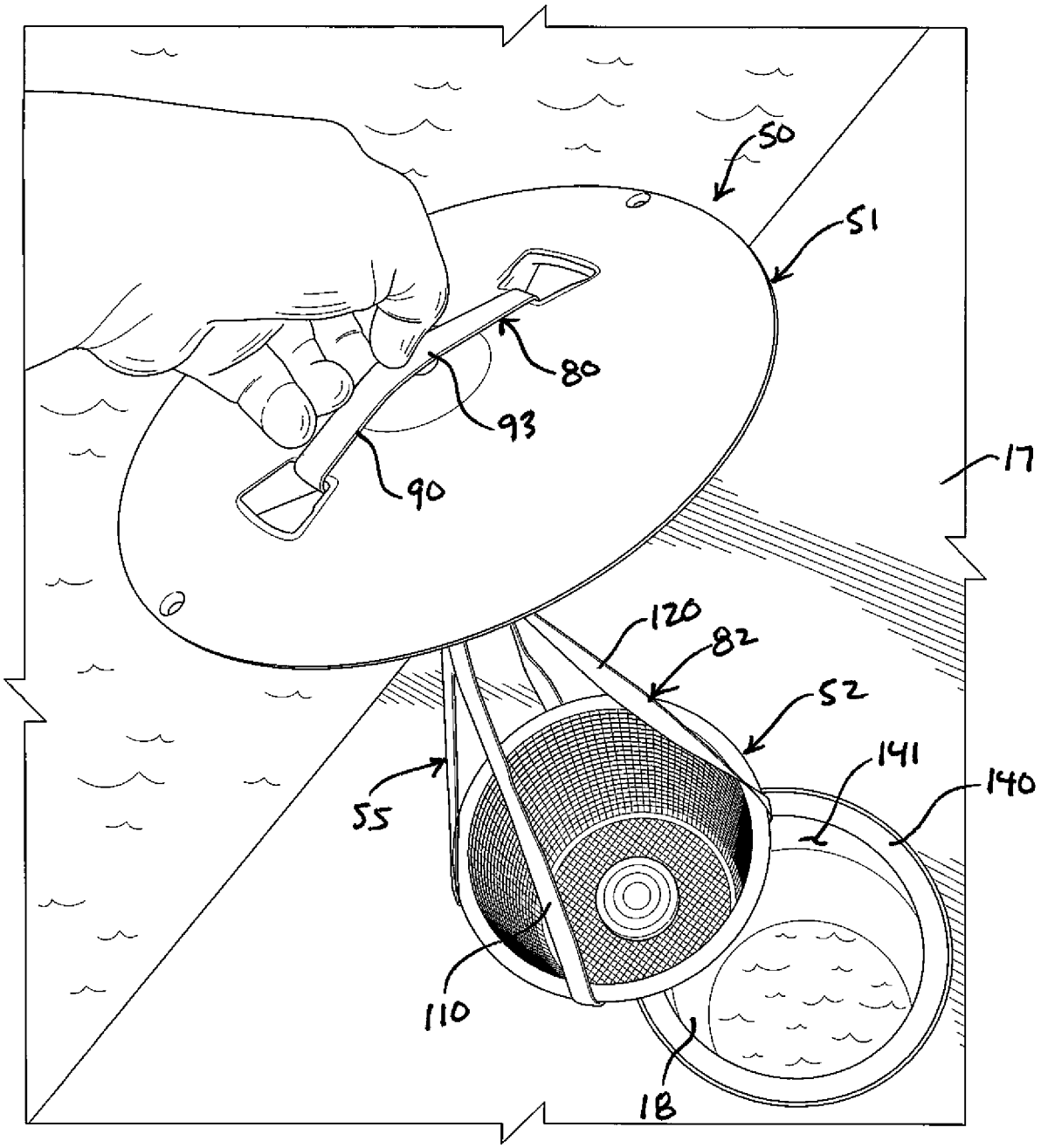
FIG. 8 is a view corresponding to FIGS. 6 and 7 illustrating the lid and the strainer basket assembly withdrawn from the skimmer device through the opening through the pool deck and suspended by hand from a handle of the flexible strap assembly.
Figure 9:
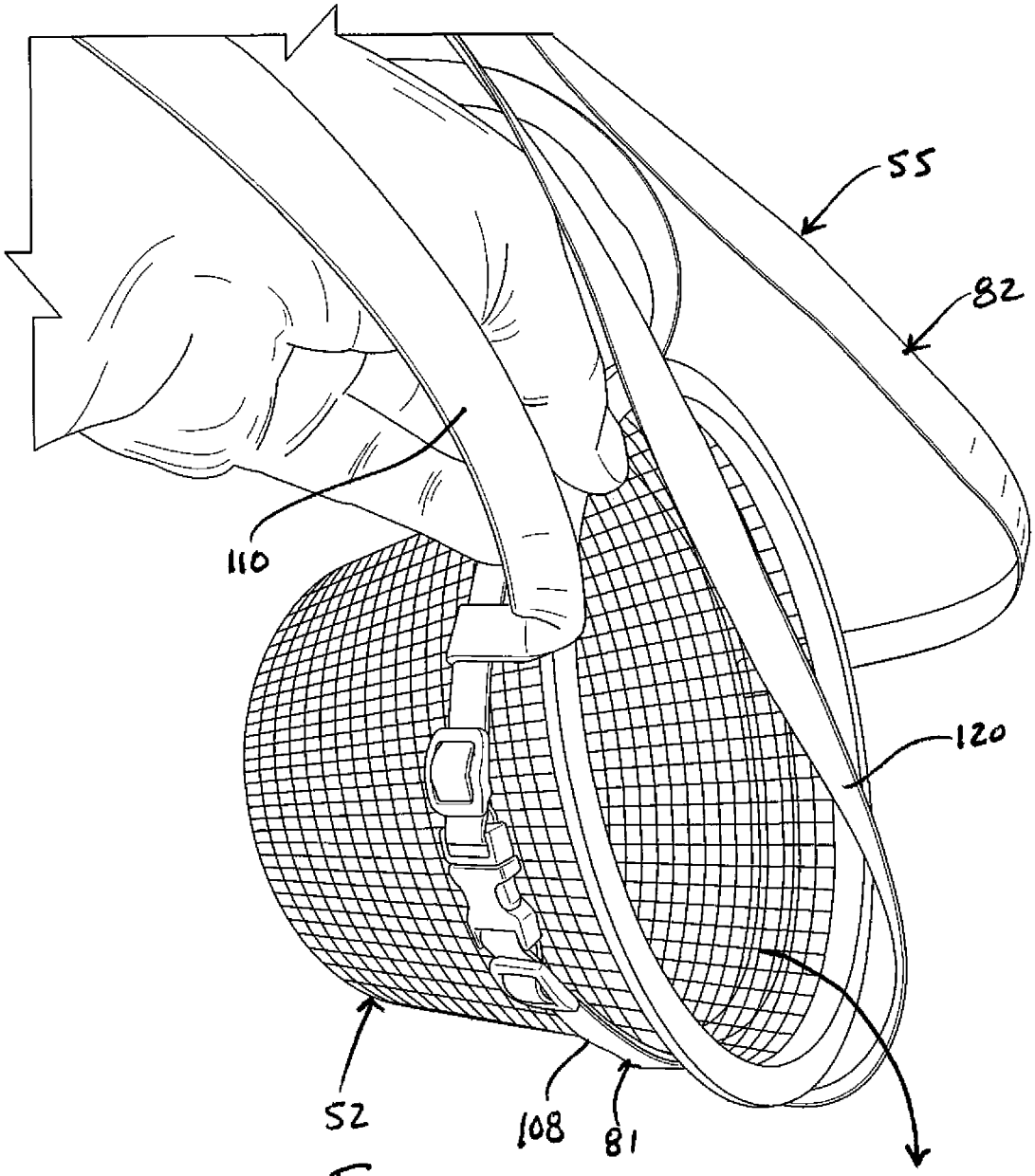
FIG. 9 is a view corresponding to FIG. 7 illustrating the basket tipped to one side for emptying the basket of debris collected therein.

Assembly 50 described above is useful with skimmer device 18 mounted adjacent to sidewall 15 in FIG. 1 and into deck 17. In FIG. 5A, skimmer device 18 extends downwardly from opening 141 proximate to deck 17 in FIGS. 6-8. In FIG. 5A, basket 52 is lowered into bottom 18A of skimmer device 18 through opening 141, and lid 51 is lowered onto the standard collar 140 of skimmer device 18 encircling opening 141 to close it as also shown in FIG. 5. When lid 51 is lowered over opening 141 to skimmer device 18 in FIG. 5A, strap 110 and 111 of connecting part 82 fall loosely in and around basket 52 without disabling basket 52 from collecting debris therein as pump 24 works to draw pool water through main drain 19 and skimmer device 18. To inspect the contents of basket 52 and to withdraw assembly 50 from skimmer device 18 for removing collected debris from within basket 52, handle 93 is taken up, such as by hand in FIG. 6 or with the aid of a hand-held implement that can be sufficiently long to enable a user to secure handle 93 without having to bend over, and pulled upwardly for withdrawing lid 51 from collar 140 encircling opening 141 to skimmer device 18. The lengths of straps 110 and 120 of connecting part 82 are, according to the invention, sufficiently long and sufficiently pliable/flexible to enable lid 51 to be initially withdrawn from opening 141 in FIG. 6 and tipped outwardly to one side of the other in FIG. 7 relative to opening 141, deck 17, skimmer device 18, and basket 52 according to the invention to enable a user to advantageously visually inspect the contents of basket 52 for determining whether basket 52 needs to be removed for cleaning advantageously without pulling against or otherwise disrupting the installed position of basket 52 within skimmer device 18. To remove basket 52 for cleaning, holding handle 93 the user need only pull lid 51 upwardly until straps 110 and 112 are sufficiently pulled tight under lid 52 suspending basket 52 thereunder, and then continue to pull lid upwardly to withdrawn basket 52 suspended under lid 51 by connecting part 82 until basket 52 is withdrawn upwardly from opening 141 at pool deck 17 in FIG. 8. At this stage, assembly 50 can be easily carried about holding handle 93 with basket 52 suspended under lid 51. To empty basket 52 of debris, a user need only take up basket 52 by hand and tip or up-end it in FIG. 9 to enable the debris contents therein to fall outwardly through opening 77 by gravity. The user may also reach into volume 76 of basket 52 if needed to scrape or scoop out the contents through opening 77. Straps 110 and 120 of connecting part 82 are, according to the invention, sufficiently pliable/flexible to enable basket 52 to tipped and up-ended relative to lid 51 to enable the removal of the contents of basket 52 without interference from lid 51 and from connecting part 82 of assembly 50. After basket 52 is cleaned of debris, which may include spraying basket 52 with water, assembly 50 need only be carried back to skimmer 18 as in FIG. 8, and lowered to lower basket 52 into skimmer 18 through opening 141 and to lower lid onto collar 140 to close opening 141. Again, handle 93 can be taken up by hand, or held by a hand-held implement to disable a user from having to bend over when installing assembly 50 and withdrawing assembly 50, according to the invention.

Figure 10:
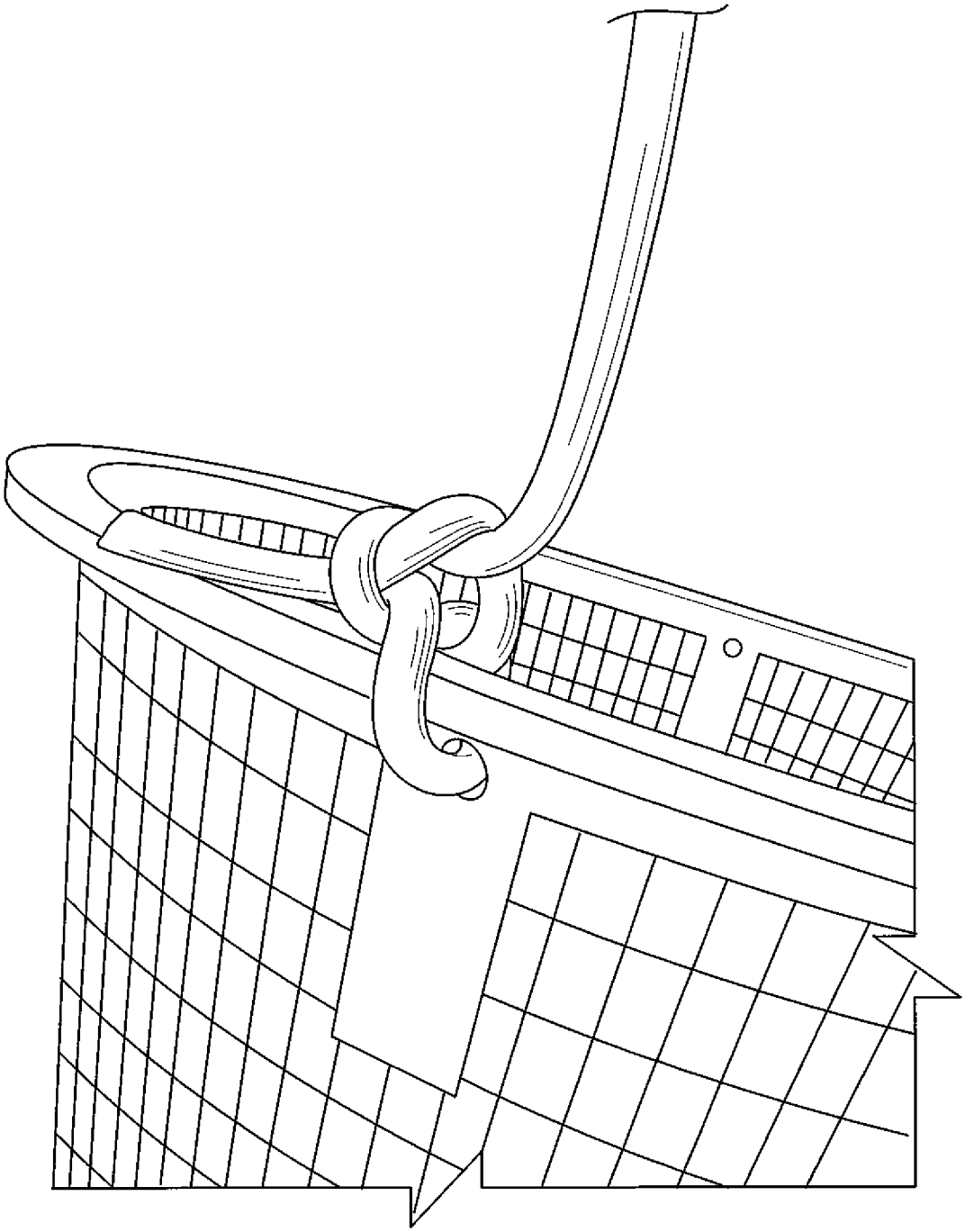
FIG. 10 is an enlarged, fragmentary view of an alternate method of connecting a strap to a strainer basket.

Strap assembly 55 in FIGS. 2 and 3 includes lid part 80, basket part 81, and connecting part 82. Lid part 80 is coupled to lid 51, basket part 81 is coupled to basket 52, and connecting part 82 connects lid part 80 to basket 52 via basket part 81. Lid part 80 and basket part 81 can be provided in varying strap configurations of one or more straps, and can be attached to lid 51 and basket 52, respectively, in various ways, such as with one or more clips, snaps, or the like. Although connecting part 82 includes two straps 110 and 120, less or more can be used in alternate embodiments. Although ends 111, 112, 121, and 122 of straps 110 and 120 are attached to basket 52 via girdle 108, girdle 108 can be omitted and ends 111, 112, 121, and 122 attached to basket 52 by other methods, such as by tying the ends through the inherent holes in basket 52 shown by way of example in FIG. 10. Further, various strap configures can be used for connecting part 82, and can be attached to lid part 80 by tying, clips, snaps, or the like, without departing from the invention. Preferably, lid part 80, basket part 81, and connecting part 82 are provided as a kit and sized and configured to enable them to be assembled with known and standard lids and strainer baskets.

The various straps of strap assembly 55 are, as disclosed, neither rigid nor inflexible, and fashioned beneficially of nylon, canvass, polypropylene/polydac webbing, or other material or combination of materials having inherently flexible, pliant, tear-resistant, rugged, and resilient material characteristics, in addition to resistance to external influences, such as to prolonged contact with water and light. The materials of the various straps of strap assembly 55 are preferably particularly resistant to sunlight, and chemicals, including chlorine, salts, and other chemicals commonly present in pool water.

The present invention is described above with reference to illustrative embodiments. However, those skilled in the art will recognize that changes and modifications may be made in the described embodiments without departing from the nature and scope of the present invention. For instance, while lid part 80 is coupled to lid 51 without modifying lid 51 in any way and while basket part 81 is coupled to basket 52 without modifying basket 52 in any way, specially constructed lid and basket constructions and associated connecting strap constructions can be employed without departing from the invention. Various further changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

The invention claimed is:

1. In a recirculating system of a swimming pool, the recirculating system having a skimmer device extending downwardly from an opening and coupled to a pump for recirculating water in the swimming pool, a lid configured to close the opening and a strainer basket configured to be received by the skimmer device for collecting debris from the water, improvements therein comprising a flexible strap coupled between the lid and the strainer basket.

2. The improvements according to claim 1, wherein the strainer basket is received by the skimmer device, the opening is closed by the lid, and the flexible strap depends downwardly into the skimmer device from the lid to the strainer basket.

3. The improvements according to claim 1, wherein the flexible strap is coupled to a lid strap coupled to the lid.

4. The improvements according to claim 3, wherein a length of the lid strap on an outer side of the lid comprises as a handle.

5. The improvements according to claim 4, wherein the lid strap is looped through openings in the lid and the length of the lid strap comprising the handle extends between the openings.

6. The improvements according to claim 1, wherein the flexible strap is coupled to a basket strap coupled to the strainer basket.

7. A lid and strainer basket assembly for use with a recirculating system of a swimming pool, the recirculating system having a skimmer device extending downwardly from an opening and coupled to a pump for recirculating water in the swimming pool, said lid and strainer basket assembly comprising:

a lid configured to close the opening;

a strainer basket configured to be received by the skimmer device for collecting debris from the water; and a flexible strap coupled between the lid and the strainer basket.

8. The lid and strainer basket assembly according to claim 7, wherein the strainer basket is received by the skimmer device, the opening is closed by the lid, and the flexible strap depends downwardly into the skimmer device from the lid to the strainer basket.

9. The lid and strainer basket assembly according to claim 7, wherein the flexible strap is coupled to a lid strap coupled to the lid.

10. The lid and strainer basket assembly according to claim 9, wherein a length of the lid strap on an outer side of the lid comprises as a handle.

11. The lid and strainer basket assembly according to claim 10, wherein the lid strap is looped through openings in the lid and the length of the lid strap comprising the handle extends between the openings.

12. The lid and strainer basket assembly according to claim 7, wherein the flexible strap is coupled to a basket strap coupled to the strainer basket.

13. In a recirculating system of a swimming pool, the recirculating system having a skimmer device extending downwardly from an opening and coupled to a pump for recirculating water in the swimming pool, a method comprising:

coupling a flexible strap between a lid and a strainer basket for the skimmer device;

lowering the strainer basket into the skimmer device through the opening and closing the opening with the lid; and the flexible strap depending downwardly into the skimmer device from the lid to the strainer basket.

14. The method according to claim 13, wherein the step of coupling the flexible strap between the lid and the strainer basket comprises:

coupling a lid strap to the lid;

coupling a basket strap to the strainer basket; and coupling the flexible strap between the lid strap and the basket strap.

15. The method according to claim 14, wherein the step of coupling the lid strap to the lid further comprises looping the lid strap through openings in the lid extending a length of the lid strap on an outer side of the lid between the openings.

* * * * *